US005469918A

United States Patent [19]

Haberman

[11] Patent Number: 5,469,918

[45] Date of Patent: Nov. 28, 1995

[54] POSITIVE DISPLACEMENT DEVICE TO IMPROVE PLACEMENT OF CEMENT PLUGS

[75] Inventor: John P. Haberman, Houston, Tex.

[73] Assignee: Texaco Inc., White Plains, N.Y.

[21] Appl. No.: 307,131

[22] Filed: Sep. 16, 1994

[51] Int. Cl.[6] ..... E21B 33/13

[52] U.S. Cl. ..... 166/291; 166/296

[58] Field of Search ..... 166/285, 286, 166/290, 291, 296

[56] References Cited

U.S. PATENT DOCUMENTS

| | | | |
|---|---|---|---|
| 1,676,785 | 7/1928 | Lewis | 166/286 |
| 3,116,793 | 1/1964 | McStravick | 166/285 |
| 3,131,767 | 5/1964 | Chancellor et al. | 166/289 X |
| 3,134,440 | 5/1964 | Nelson | 166/290 X |
| 3,170,516 | 2/1965 | Holland et al. | 166/286 |
| 3,208,521 | 9/1965 | Holland et al. | 166/286 |
| 3,208,525 | 9/1965 | Caldwell et al. | 166/286 X |
| 3,872,925 | 3/1975 | Owen et al. | 166/135 X |
| 4,042,031 | 8/1977 | Knapp | 166/276 |
| 4,696,343 | 9/1987 | Anderson et al. | 166/169 X |
| 4,972,906 | 11/1990 | McDaniel | 166/276 |

*Primary Examiner*—Roger J. Schoeppel

*Attorney, Agent, or Firm*—James L. Bailey; Kenneth R. Priem; William J. Beard

[57] ABSTRACT

Cement plugs are positively placed in a wellbore by placement of a bridge plug immediately beneath the depth where the plug is intended and release of a seal allowing flow of cement slurry from a slurry containment tube as the tube is withdrawn to cause a positive piston-like displacement of the fluid in the wellbore.

4 Claims, 3 Drawing Sheets

POSITIVE DISPLACEMENT DEVICE TO IMPROVE PLACEMENT OF CEMENT PLUGS

BACKGROUND OF THE INVENTION

1. The Field of the Invention

The present invention relates to a method and apparatus for improving the placement of cement plugs.

2. The Prior Art

Cement plugs in wellbores often fail because the fluid in the well mixes with the cement slurry as the slurry is placed. When the slurry sets up, it does not form a solid competent plug. The current techniques rely on the cement slurry to sweep other fluids out of the way by simple fluid displacement. However, the cement slurry tends to finger through any gelled fluid in the wellbore rather than to spread out and displace gelled fluid from the full bore of the well. Various mechanical means have been used to stir and fluidize the fluid in the wellbore to improve displacement, but a cement slurry is not positively confined in such a way that it can be prevented from mixing with other fluid in the well. Consequently, large volumes of cement slurry are used to improve the likelihood of obtaining adequate displacement of the other fluids. This strategy has had limited success because of the stability of flow paths through gelled fluid, once such paths are established.

SUMMARY OF THE INVENTION

The present invention concerns a relatively simple device that uses a positive displacement technique to give full bore plugs with little or no mixing of the cement with well fluids. The results provide a high degree of control over the cement placement process.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
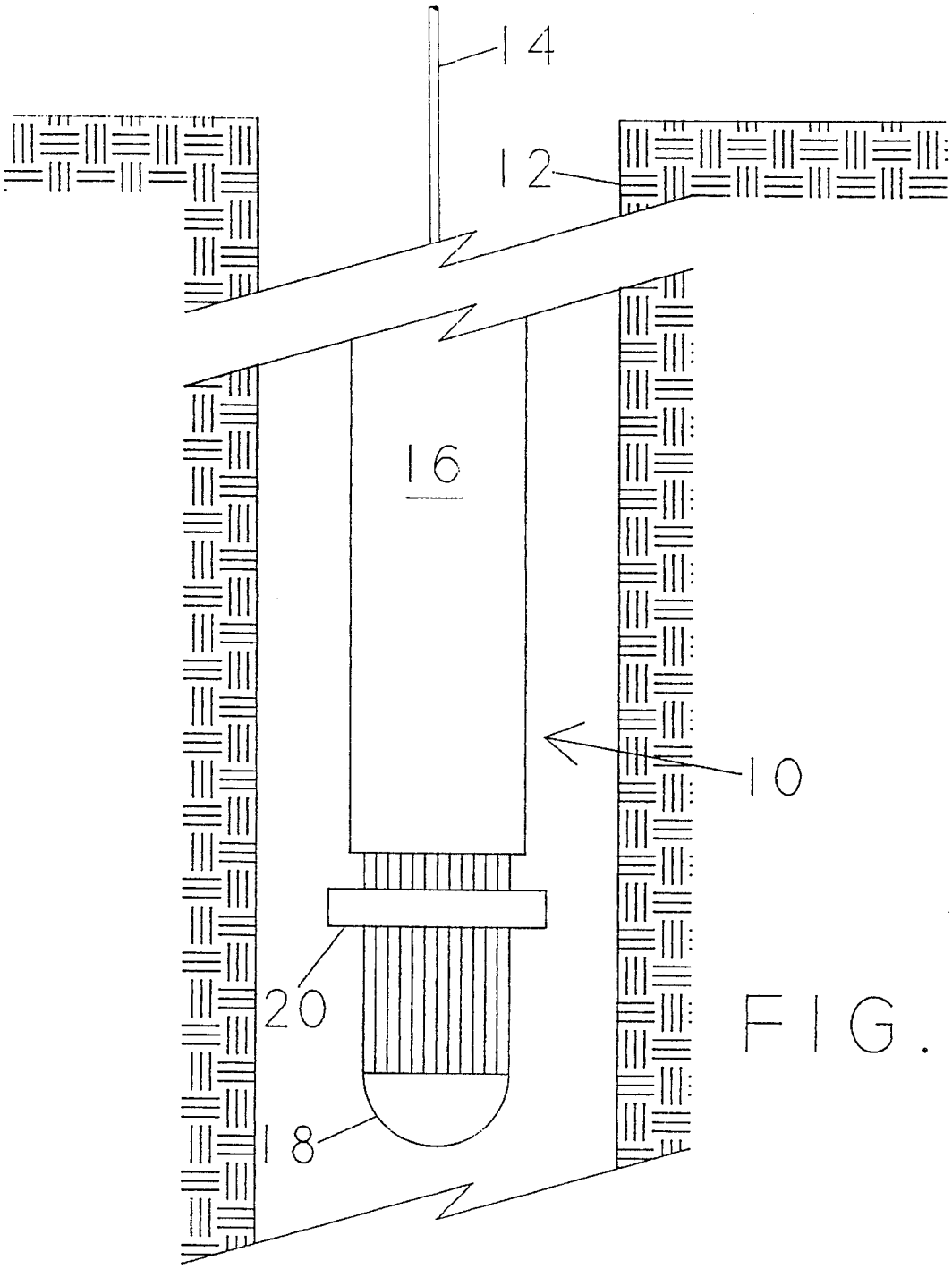
FIG. 1 is a vertical schematic section through the wellbore with the device of the present invention situated therein prior to being deployed.
Figure 2:
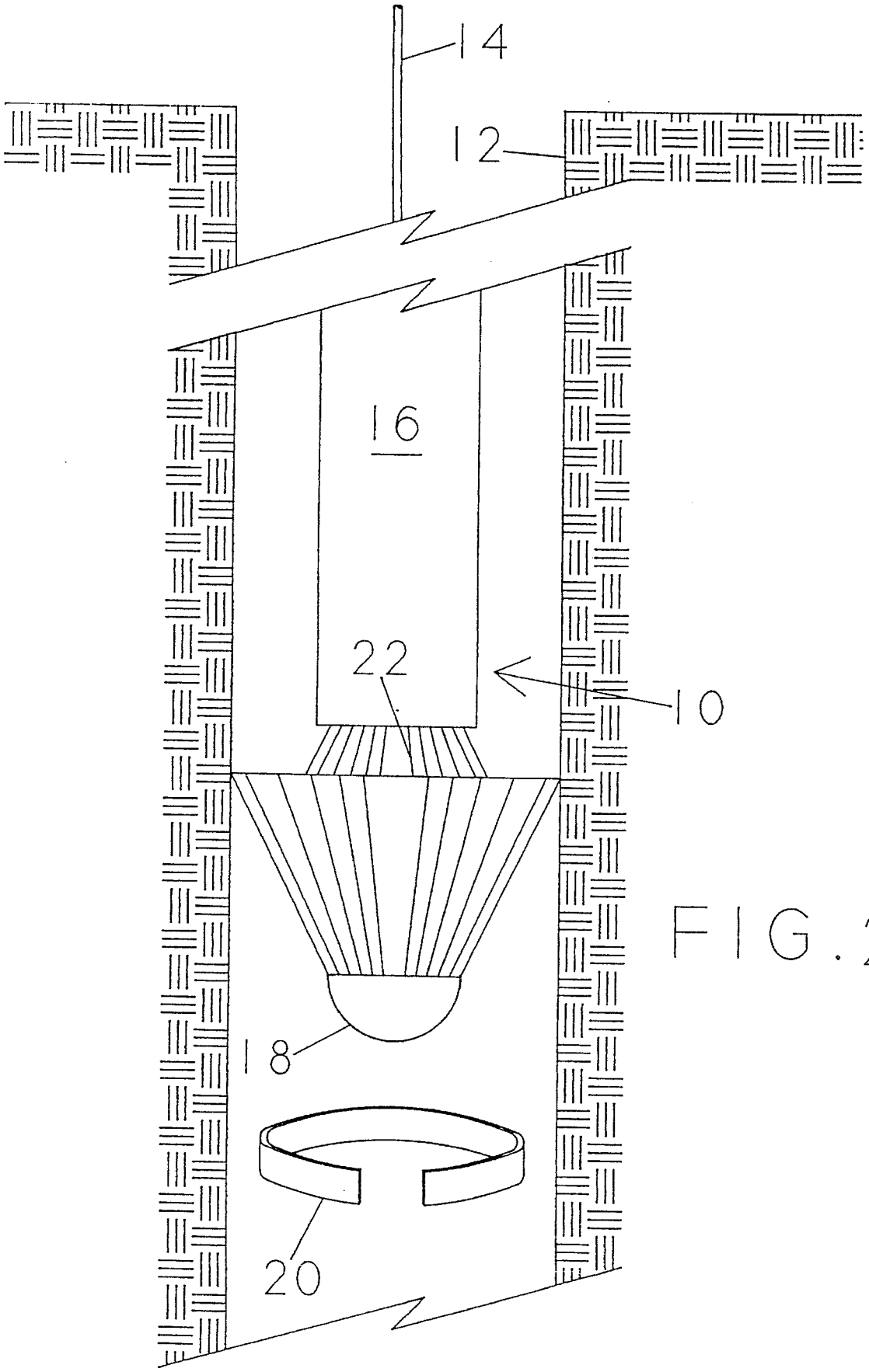
FIG. 2 is a detailed view of the apparatus of FIG. 1 in partially deployed condition.

FIG. 1 shows the subject device 10 suspended in a wellbore 12 by means of cable 14 with the device including a cement slurry containment means, such as bailer tube 16, a bridge plug 18, and a bridge plug retaining ring 20. In FIG. 2 it will be seen that there is also a seal 22 formed between the bailer tube 16 and the bridge plug 18.

The following example will describe how the present invention is used for the placement of cement plugs during well abandonments, but the basic technology could be applied to any liquid or slurry that is placed in a well for any purpose. In the present example a dump bailer 16 is used because this invention is especially applicable to the bailer use. It could also be used for coiled tubing operations or for operations utilizing a drilling or workover rig. The principles might apply equally well to other examples representing alternative designs of equipment and techniques.

Figure 3:
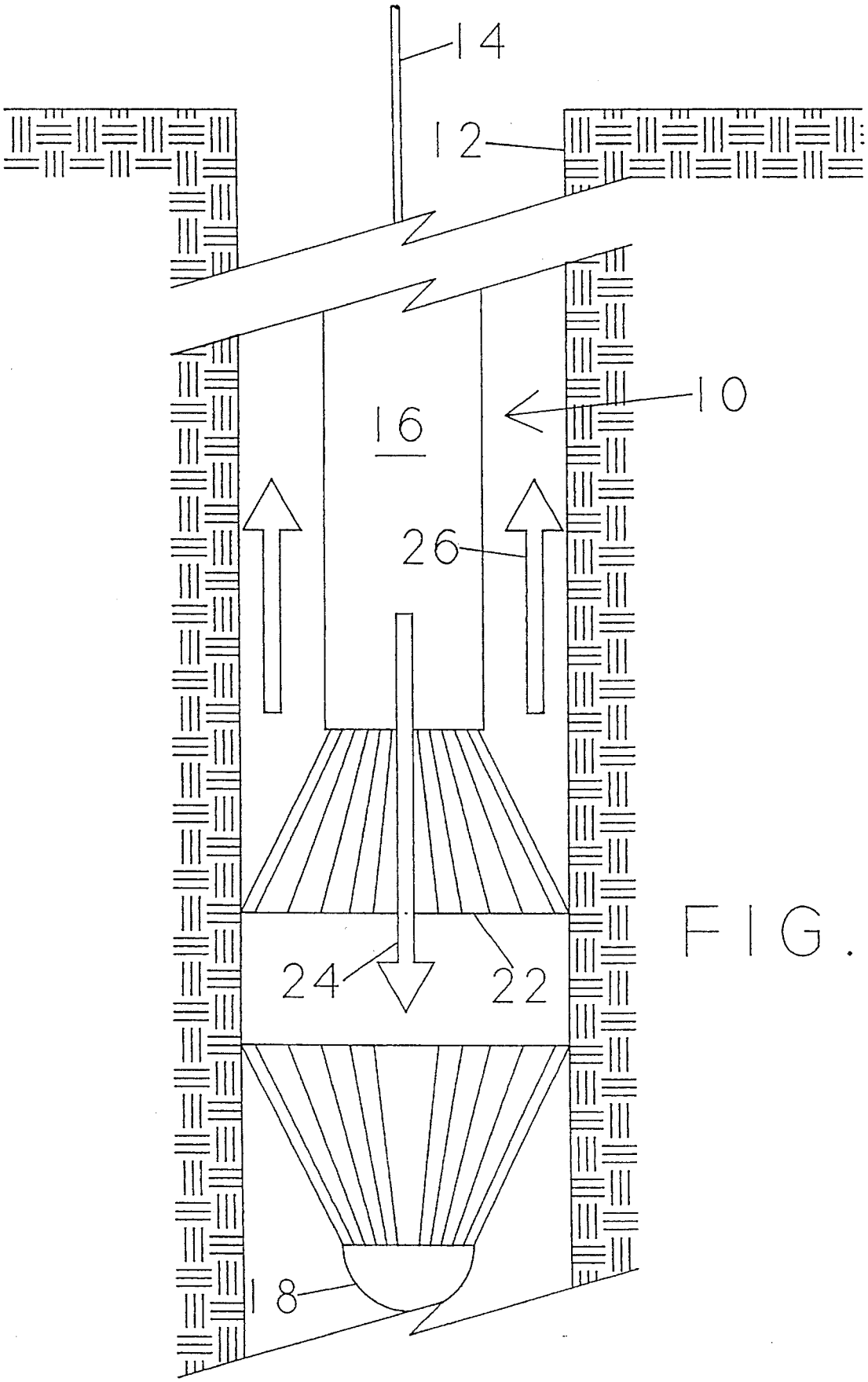
FIG. 3 is a vertical section, similar to FIGS. 1 and 2, showing the subject invention in a fully deployed condition.

In the present example a large dump bailer 16 that holds enough cement slurry to set a plug in one trip would have a sealing mechanism 22 attached to the bottom of the bailer 16, and also a detachable bridge plug 18. Initially the bridge plug 18 and sealing mechanism 22, would be held in place by a retaining ring 20, while the bailer 16 was filled with cement slurry 26 and lowered into the well 12 as shown in FIG. 1. When the bailer 16 has reached the desired position, the retaining ring 20 would be released by conventional means setting the bridge plug 18 and releasing the bailer seal 22 (as shown in FIG. 2). As the bailer 16 is slowly raised it will act in a manner similar to a hollow piston forcing the cement slurry down, in the direction of arrow 24, into the space, between the bridge plug 18 and the seal 24, while the fluid is displaced upwardly in the direction of arrows 26, as shown in FIG. 3. The seal 22 need not be completely leak tight to meet the objectives of this invention. The results still would be improved placement of the cement slurry by positive displacement mechanism as shown in the sequence of figures. The seal 22 might remain attached to the bailer 16 to be reused or might be discarded when the bailer is retrieved. Alternatively, it might be especially designed to be detached from the bailer and act like a lid on top of the slurry to hold it in place.

The dump bailer of the preferred embodiment is merely representative of the many available devices for passing cement slurry down a borehole. Coiled tubing or regular drill pipe could also be used. In either of these cases, once the bridge plug is deployed and the seal broken, the tubing or pipe would be withdrawn at a rate to allow positive displacement of the fluid by the cement slurry.

The present invention may be subject to many modifications and changes without departing from the spirit or essential characteristics thereof. The present embodiment should therefore be considered in all respects as illustrative and restrictive of the scope of the invention as defined by the appended claims.

I claim:

1. A method for improved placement of cement plugs in wellbores comprising the steps of:

providing a bridge plug having a bridge plug retainer means removably mounted thereon;

providing movable cement slurry containment means containing a cement slurry;

providing releasable sealing means temporarily holding said bridge plug to said cement slurry containment means;

positioning said bridge plug at a depth below where placement of a cement plug is intended in the wellbore;

releasing said bridge plug retainer means;

releasing said sealing means between said bridge plug and said cement slurry containment means; and withdrawing said cement slurry containment means and said released sealing means upwardly and creating a piston-like action between said released sealing means and the wall of the wellbore to positively displace fluid in the wellbore as cement slurry flows downwardly from said cement slurry containment means against said bridge plug.

2. A method according to claim 1 wherein said cement slurry containment means comprises a bailer tube.

3. An apparatus for positively placing a cement plug in a wellbore comprising:

a bridge plug;

bridge plug retainer means removably mounted on the bridge plug;

movable cement slurry containment means containing a cement slurry; and seal means releasably joining said cement slurry containment means to said bridge plug for forming a seal between said seal means and the wall of the wellbore whereby removal of said bridge plug retainer means sets the bridge plug in fixed position and release of said seal means together with upward withdrawal of said cement slurry containment means causes a positive upward displacement of fluid in the wellbore with the cement slurry from the cement slurry containment means.

4. An apparatus according to claim 3 wherein said cement slurry containment means comprises a bailer tube.

* * * * *